United States Patent [19]

Graf et al.

[11] 3,936,004

[45] Feb. 3, 1976

[54] MATERIAL REDUCER

[75] Inventors: Carl R. Graf, Whitehall; Harry E. Janes, Chester; Anthony W. Slikas, Norristown, all of Pa.

[73] Assignee: Pennsylvania Crusher Corporation, Broomall, Pa.

[22] Filed: May 13, 1974

[21] Appl. No.: 469,563

Related U.S. Application Data

[63] Continuation-in-part of Ser. No. 361,002, May 16, 1973.

[52] U.S. Cl. ..... 241/5; 241/27; 241/29; 241/55; 241/186.3; 241/275

[51] Int. Cl.[2] ..... B02C 23/38

[58] Field of Search ..... 241/47, 55, 79, 82, 186 R, 241/186.2, 186.3, 189 R, 274, 275, 5, 27, 29, 79.1; 193/10; 302/59, 60, 61

[56] References Cited

UNITED STATES PATENTS

| | | | |
|---|---|---|---|
| 1,195,529 | 8/1916 | Street et al. | 302/61 X |
| 1,384,821 | 7/1921 | Blum | 241/55 |
| 1,753,437 | 4/1930 | Lykken | 241/55 X |
| 1,959,465 | 5/1934 | Dryfoos | 241/186.3 X |
| 2,226,330 | 12/1940 | Symons | 241/186 R |
| 2,553,234 | 5/1951 | Boucher | 241/274 X |
| 2,828,923 | 4/1958 | Kramer | 241/186 R |
| 2,931,581 | 4/1960 | Lykken et al. | 241/55 X |
| 3,423,132 | 1/1969 | Blanton et al. | 302/61 |
| 3,442,458 | 5/1969 | Meyer | 241/189 R |

*Primary Examiner*—Granville Y. Custer, Jr.
*Attorney, Agent, or Firm*—Pollock, Vande Sande & Priddy

[57] ABSTRACT

A material reducer for coal, lignite, ore, stone, rock, oil shale and the like which employs rotary hammers, bars or the like not only to crush the material but also to propel the crushed material upwardly along a confined or partially confined path or discharge chute which empties onto an output conveyor, a screen or other processing equipment. The chute is provided with means to reduce or eliminate clogging at the discharge port from the reducer. The input end of the reducer can be at a level sufficiently low to be supplied by mobile loading units such as front-end loaders, over-the-head loaders, and others. The center of gravity can also be substantially lowered, providing more stability without the normal cumbersome frame and support structure. Reducers constructed in accordance with the invention can be made far lighter and more mobile than existing mobile reducers with the same capacity, and therefore provide a practical way of eliminating the use of trucks, with their attendant noise, dust and pollution, to haul uncrushed minerals from the bottom of a mine or quarry to a stationary crusher at the surface.

25 Claims, 9 Drawing Figures

MATERIAL REDUCER

Cross-Reference to Related Application

This application is a continuation-in-part of Serial No. 361,002 filed May 16, 1973 by Carl R. Graf, a co-inventor herein, for the invention Material Reducer, the disclosure of which is hereby incorporated by reference.

BACKGROUND OF THE INVENTION

This invention relates to methods and apparatus for crushing various materials. The invention is especially useful for reducing ore, rock, stone, coal, and the like. In mining or extraction, random size pieces of mineral material are produced, some too large to be carried out of the mine or quarry on conveyor belts of practical and economical width. Bucket or skiff conveyors have been tried, but have been expensive to build, operate and maintain. Thus, motor trucks have been used to carry uncrushed minerals from the bottom of mines or quarries to a distant or upper surface for crushing.

For various reasons, including perhaps the desire to provide reversible hammer rotation and design symmetry, the massive crushers most commonly used heretofore in the crushing of large chunks of heavy minerals have included a top inlet and bottom outlet. Positioning a conveyor belt below such a crusher to receive crushed material from the outlet involves elevating the crusher above ground on heavy supporting framework, or constructing a trench beneath it. This can raise the inlet to a difficult or prohibitive height for conventional mobile loaders or loading equipment, and/or makes the crusher considerably less mobile or less stable and more expensive to install.

In principle, mineral extraction costs can be reduced by crushing the large chunks to a convenient size in the quarry or at the mine face, and then carrying them to the surface by belt conveyors of practical size and width. However, under many circumstances, the above-described problems and the size and expense of available mobile crushers frustrate the use of this money-saving procedure.

Objects of the Invention

It is a primary object of the present invention to provide a relatively simple and inexpensive crusher which makes it unnecessary to truck mineral materials from the bottom of a mine or quarry.

Another object of the invention is to provide a crusher machine which effectively performs the necessary functions of far heavier and more expensive mobile crushers heretofore used.

Still another object is to provide crushing apparatus which can be conveniently operated in a mine or quarry and which may be used to crush moisture laden materials while reducing or eliminating clogging.

Yet another object is to provide a crusher which can be discharged directly to a conveyor, screen, or other transport and processing equipment and yet requires no high elevating framework or subjacent trench.

A further object is to provide crushing means which can be loaded directly by mobile loaders such as front-end or over-the-head loaders.

Another object is to provide crushing apparatus which can itself be readily constructed in a mobile form which is relatively stable against tipping, is relatively simple and light in weight, and yet provides a convenient discharge.

Another object is the provision of crusher machines having the aforesaid features which may be used to advantage in the crushing of coal, ores and other materials, but particularly in the crushing of coal or limestone.

Yet another object is to provide a method of impact crushing mineral materials which can significantly reduce problems heretofore associated with the transport of mineral materials from the floor or face of a mine or quarry.

Upon consideration of the summary and the various embodiments of the invention described below, it will be apparent that the invention can be embodied in forms which attain some or all of the above objects. Moreover, additional objects will occur to those skilled in the art. In any event, the practice of the present invention offers various significant advantages.

Summary of the Invention

The disclosed apparatus provides material reduction apparatus for mineral materials such as ore, rock, stone, oil shale, coal, lignite and the like. Such apparatus comprises a rotor having any suitable form of impact members mounted thereon, for instance, fixed or pivotable hammers or bars. These are arranged in spaced relationship about the rotor, and their peripheries define an impactor circle, of which there may be several.

The rotor is mounted for rotation in a housing having a curved, imperforate impact surface. "Imperforate" means that the surface is regular or irregular, but is for the most part free of "through" holes; for instance, if the surface is in the form of a plate punched with holes, this plate will normally be backed up by a blind plate which closes off all or most of the holes. On the other hand, the impact surface may be provided by filling the bottom of an enlarged housing with crushed mineral material, such as the material which is crushed in said apparatus, until the level of said crushed material reaches a level slightly below but adjacent to said impactor circle.

The aforesaid impact surface defines the outer perimeter of a reaction zone subtending an arc in said impactor circle which may include the lowest point in said impactor circle and extend upwardly on either side of said point. Within this zone, the rotor impact members, the material to be crushed and the impact surface interact to crush the material. In the case of a rotor having several circles of impact members, there may be several of such zones in which the zones themselves and/or the hammer circles may have different diameters or be physically separated from one another by members intermeshing with laterally adjacent impact members. Generally, the impact surface or surfaces are free of discontinuous components intermeshing with (or in the lateral space between) laterally adjacent pairs of impact members. "Discontinuous components" refers to a durable member or members providing a series of inward projections from the impact surface or teeth spaced peripherally about the impact surface and separated by gaps sufficiently large to momentarily catch, stop or reverse the direction of a significant proportion of the mineral material which enters the gaps and collides with the projections.

The apparatus includes an inlet duct for charging the material to the rotor housing. The inlet duct may open into the housing directly adjacent the reaction zone or at any other suitable location. For instance, the duct may open into the housing within the impactor circle or alongside it. Preferably, the inlet is open to the atmosphere, so that air may be drawn or forced into the housing as the feed material enters, and the air and feed may be caused to follow a common path through the apparatus until after they have both entered a discharge chute or duct. Also, the inlet may be connected with or include, any suitable means for controlled feeding of material into the housing in a predetermined range of mass rate, e.g., as by using an input conveyor means, including without limitation vibrating pan feeders (which are preferred), apron conveyors, table feeders and (where the feed material is in relatively small pieces) a belt conveyor.

The invention includes a discharge chute which at least partially encloses a reduced material departure path. The path includes a lower surface which extends longitudinally away from the rotor and into the material departure path to an extent sufficient to cause scouring of the lower surface by the discharged material, while preserving the major portion of the kinetic energy originally imparted to the material by the rotor, whereby clogging of the chute by the material is reduced or eliminated. In certain embodiments of the invention, the material departure path is generally elevated above a line tangent to the impact surface drawn from the downstream end of the reaction zone. In one embodiment, the lower surface of this chute is of flat, curved or involute form extending from the downstream end of the reaction zone at an angle above the tangent line just discussed. This orientation of the lower surface is important since it minimizes or eliminates the accumulation of fine particles of moist material at the lower end of the chute due to the scouring effect of heavier particles skimming along the elevated lower surface as they travel up the chute. The angled lower surface changes the direction of movement of material pieces and tends to absorb an initial and preferably minor portion of their energy; nonetheless, the discharge chute may be provided in addition with a direction changing and energy absorbing means which deflects the reduced material toward an adjacent conveyor or handling station, at the downstream end of the chute.

The additional direction changing and energy absorbing means may be of any type, including a rock box, chain curtain, angled metal surface or the like. It is connected with or placed beyond the discharge chute operationally, if not physically, and is oriented in the material departure path in position for receiving all — or at least the larger — pieces thrown off by the rotor, for slowing such material by absorbing an additional and preferably major portion of the remaining kinetic energy thereof, and for discharging such material from the chute without recycling to the rotor. Such means may discharge the material which reaches it be causing it to descend either directly or through any suitable discharge means, preferably unobstructed, including a further chute to any suitable receiver. This may for instance be a vehicle, a conveyor, a screen, the inlet of an additional material reduction apparatus, or another transport or processing apparatus. In a preferred embodiment, the discharge chute and its angled direction changing and energy absorbing lower surface are arranged to convey the entire range of materials thrown off by the rotor to the additional direction changing and energy absorbing means, and from thence to a discharge outlet without separation of the pieces of differing particle size and without significant return of material from either direction changing and energy absorbing means to the rotor. This discharge outlet is more preferably at least partly and preferably completely at an elevation which is higher than the low point of the impactor circle and most preferably higher than the axis of the rotation of the rotor.

Also, it should be apparent that when ready for use, the apparatus will be provided with means for rotating the rotor with the periphery of the rotor adjacent the impact surface moving in the direction of said outlet channel and with sufficient speed to throw reduced material up the discharge chute to the additional energy absorbing and direction changing means.

In accordance with the method aspects of the present invention, air and mineral feed are introduced into a housing through an inlet opened to the atmosphere. The air and material feed are caused to flow along a common path from said inlet to a rotor in said housing. The feed material is contacted with rotating impact members on said rotor and with an impact surface in a reaction zone subtending an arc in said impactor circle which may include the lowest point in the circle described by the rotating impact members at their peripheries and extend upwardly on either side of said point. Material crushed by said rotor and impact surface is thrown upwardly and outwardly from the rotor along an at least partially confined discharge chute located above a tangent from the impact surface drawn from the downstream end of the reaction zone. Using the kinetic energy imparted thereto by said rotor, the crushed material is thrown to a level above the axis of rotation of the rotor. While the crushed material is still in flight, at least some of the pieces of crushed material are impinged against an angled lower surface of the discharge chute to scour that surface of agglomerated particles and then passed on upwardly to an additional energy absorbing and direction changing means. Then the crushed material is caused to descend from the additional energy absorbing and direction changing means and to discharge from the apparatus without further contact with said rotor.

With the aid of the drawings described below, a few illustrative embodiments of the appartus and the method of the present invention will now be described. A person skilled in the art will readily recognize that other embodiments are possible, and that the invention is not limited to the embodiments shown.

DETAILED DESCRIPTION OF VARIOUS EMBODIMENTS

Figure 1:
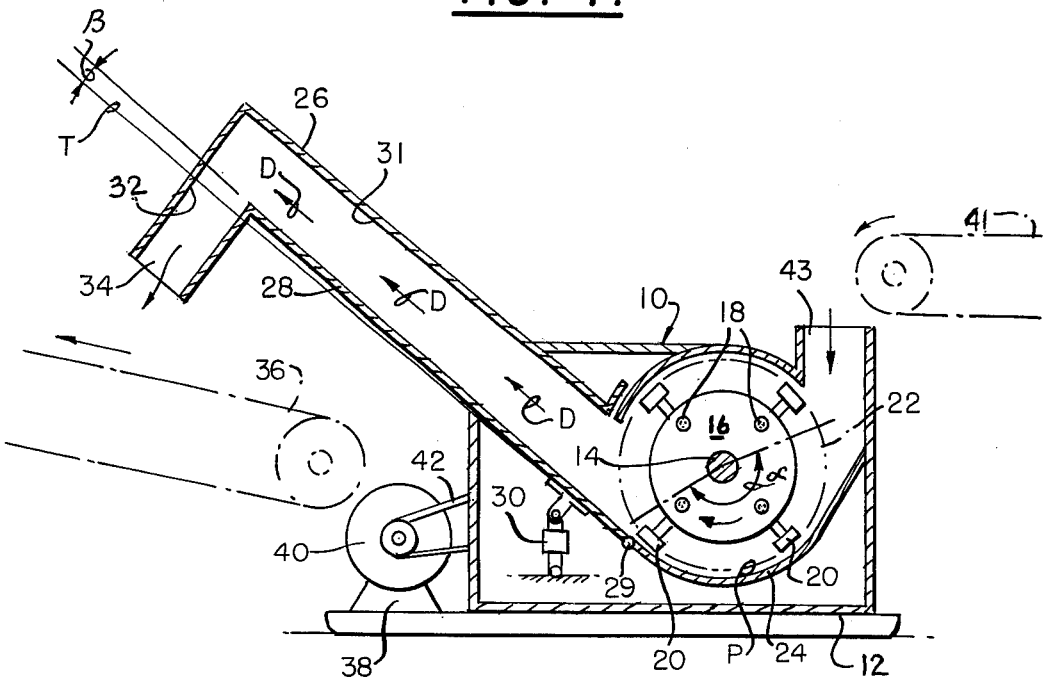
FIG. 1 is a side elevational view, partly in section, of a crushing machine embodying this invention.

There follows a detailed description of preferred embodiments of the invention, reference being had to the accompanying drawings, in which like reference numerals generally indicate like elements of structure in each of the several FIGURES.

A crusher 10 embodying the invention is shown schematically in FIG. 1. The crusher has a housing 12 with rotor shaft 14 mounted for rotation therein, in suitable bearings (not shown). A plurality of rotor discs 16 may be spaced axially on the rotor shaft 14, each carrying four hammer shafts 18, mounted at 90° intervals near the peripheries of the rotor discs 16. The discs 16 serve as pivotal mountings for four sets of impact members, e.g., hammers 20, including four hammers in each set which are laterally (or axially) spaced relative to each other. The hammers could be mounted at random spacings about the discs, as long as weight balance about the rotor shaft is maintained. On rotation of the rotor shaft 14, rotor discs 16 and hammer shafts 18, the outer peripheries of the hammers 20 define an impactor or hammer circle 22.

The housing 12 includes a curved, imperforate impact surface or member 24. Surface 24 defines the periphery of a reaction zone subtending an arc alpha ($a$) in said impactor circle which may include the lowest point P in impactor circle 22 and extend upwardly on either side thereof. Within this zone, the impact members, the material to be crushed and the impact surface interact to crush the material.

While it is preferred that the impact surface be a fabricated member, preferably of highly wear resistant metal, the impact surface may be fabricated of other materials. For instance, it is contemplated that all or part of the fabricated impact surface 24 might be omitted, leaving the lower portion of the volume of housing 12 unoccupied. Upon the feeding of mineral material to the crusher machine, this open volume would become packed with crushed feed material, the level of which would rise in the housing to a level controlled by the rotation of the impact members and by the passage of additional feed material, and would thereby be formed into a curved impact surface.

The apparatus includes a discharge chute or duct 26 which at least partially encloses a reduced material departure path generally corresponding to the trajectory imparted to the material at the downstream end of the inter-reaction zone and generally indicated by arrows D. This channel may be a duct of tubular or other shape enclosed partially or completely throughout its length and circumference. It will however be sufficiently enclosed to confine or at least partially confine the reduced material proceeding along departure path D. The surfaces of this duct 26 may be fabricated of metal, as shown, or may be provided with rock facings, e.g. rock boxes. In the preferred embodiment, the duct 26 has a lower surface or confining member 28 which has an upwardly sloping or curving surface extending from the downstream end of the impact surface 24 along a path elevated above a line T tangent to the end of the essentially circular impact surface 24, as shown, Material exiting from the crusher will initially follow a trajectory which is parallel and closely adjacent to tangent line T, thus the upwardly sloping of curving surface of member 28 lying above tangent T will be constantly struck and scoured by crushed material as it moves up discharge chute 26, thereby changing the direction of and absorbing some energy from the crushed material as it moves.

The surface of member 28 may also be coincident with tangent T to minimize impact by the passing crushed material; however, in this instance it has been found that fine particles in the moving crushed material tend to pile up at the lower end of member 28, especially when the material being crushed is somewhat moist. This piling up of moist, fine particles can cause clogging of the discharge chute, necessitating shutdown time for cleaning. To reduce or eliminate such clogging, an upwardly sloping or curving surface on member 28 is preferred, as discussed in greater detail with regard to FIG. 5. To permit adjustment in the amount of scouring received by the surface of member 28 and the extent that the direction and energy of the crushed material are altered, a hinge 29 may be provided to permit adjustment of the angle B between tangent line T and member 28, using appropriate adjustment means 30, such as a screw jack or similar device. Also, in the preferred embodiment, the upper surface 31 terminates in an additional direction changing and energy absorbing means 32, e.g. a rock box, chain curtain or fabricated metal impact surface, oriented in the material departure path D and positioned for slowing the material by absorbing a major portion of the kinetic energy thereof.

In this preferred embodiment, the energy absorbing and direction changing means 32 delivers all of the material received from the rotor means to a discharge outlet 34. The discharge outlet 34 is preferably entirely open or unobstructed, so that the entire quantity of reduced material which strikes the energy absorbing and direction changing means may descend therefrom to any suitable receiver. When the discharge outlet is at least partly, or preferably completely, at an elevation which is higher than the low point P of impactor circle 22, and, most preferably, higher than the axis of rotation of the rotor shaft 14, the output of crushed material from discharge outlet 34 may readily be fed directly onto a conveyor 36 without placing the conveyor in a trench under the crushing apparatus and/or without elevating the crushing apparatus on a high framework with the conveyor running underneath. This also makes it possible to mount the crusher on simple transport means, such as skids 38, crawler tracks, walking mechanism, wheels or the like so that it may be moved to any desired location in a mine, quarry or other facilities.

Certain advantages may accrue from properly engaging the base, e.g. skids 38, of the crusher with the ground surface, e.g. the bottom of a mine or quarry. This can be done for instance by interposing between the base and the ground surface a resilient sheet member which is free of attachment with the ground and which may be a durable porous synthetic and/or natural elastomer or blend thereof. The sheet will have a substantial thickness and resilience properties such that its upper and lower surfaces will deflect horizontally relative to one another in response to horizontal vibrations of the machine, while retaining frictional engagement with the machine and ground. The sheet may also undergo localized vertical deflection to accommodate irregularities in the ground surface. Thus, the sheet temporarily secures the machine at the desired location on the ground, permitting ready removal and at least partially reducing any tendency of the machine to creep. The machine may also be secured by a tether, if desired.

In view of the intended manner of operation of the apparatus, those skilled in the art will readily recognize from the foregoing description that the apparatus, when ready for use, will be provided with a means, such as electric motor 40 and drive belts 42, for rotating the rotor 14 with the periphery of the rotor adjacent the impact surface 24 moving in the direction of discharge chute 26 and with sufficient speed to throw reduced material up discharge chute 26 to the energy absorbing and direction changing means 32. Infeed conveyor 41 may be used to deliver material to be crushed to inlet opening 43.

Figure 2:
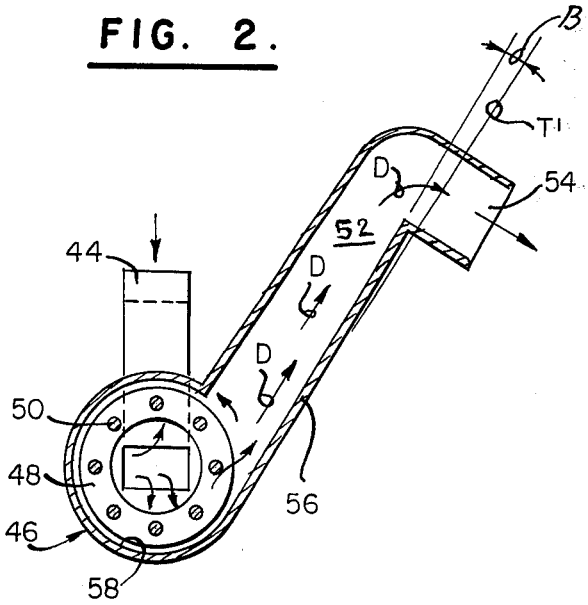
FIG. 2 is a schematic illustration of an alternate form of crushing machine according to the present invention.

In FIG. 2, the uncrushed ore or other material is delivered through a feed-in chute 44 into the axial center of a conventional cage mill 46 which includes a pair of spaced-apart discs 48 (only one shown) which support there between a plurality of rods or bars 50 which crush the ore material and throw it upwardly into the discharge chute 52 and out the nozzle 54. Discharge chute 52 includes a lower confining member 56 which has an upwardly sloping or curving surface extending from the downstream end of impact surface 58 of cage mill 46, along a path elevated above a line T′ tangent to the impact surface in a manner identical in principle to that discussed regarding the embodiment of FIG. 1. Though not illustrated, member 56 may also be hinged, if desired.

Figure 3:
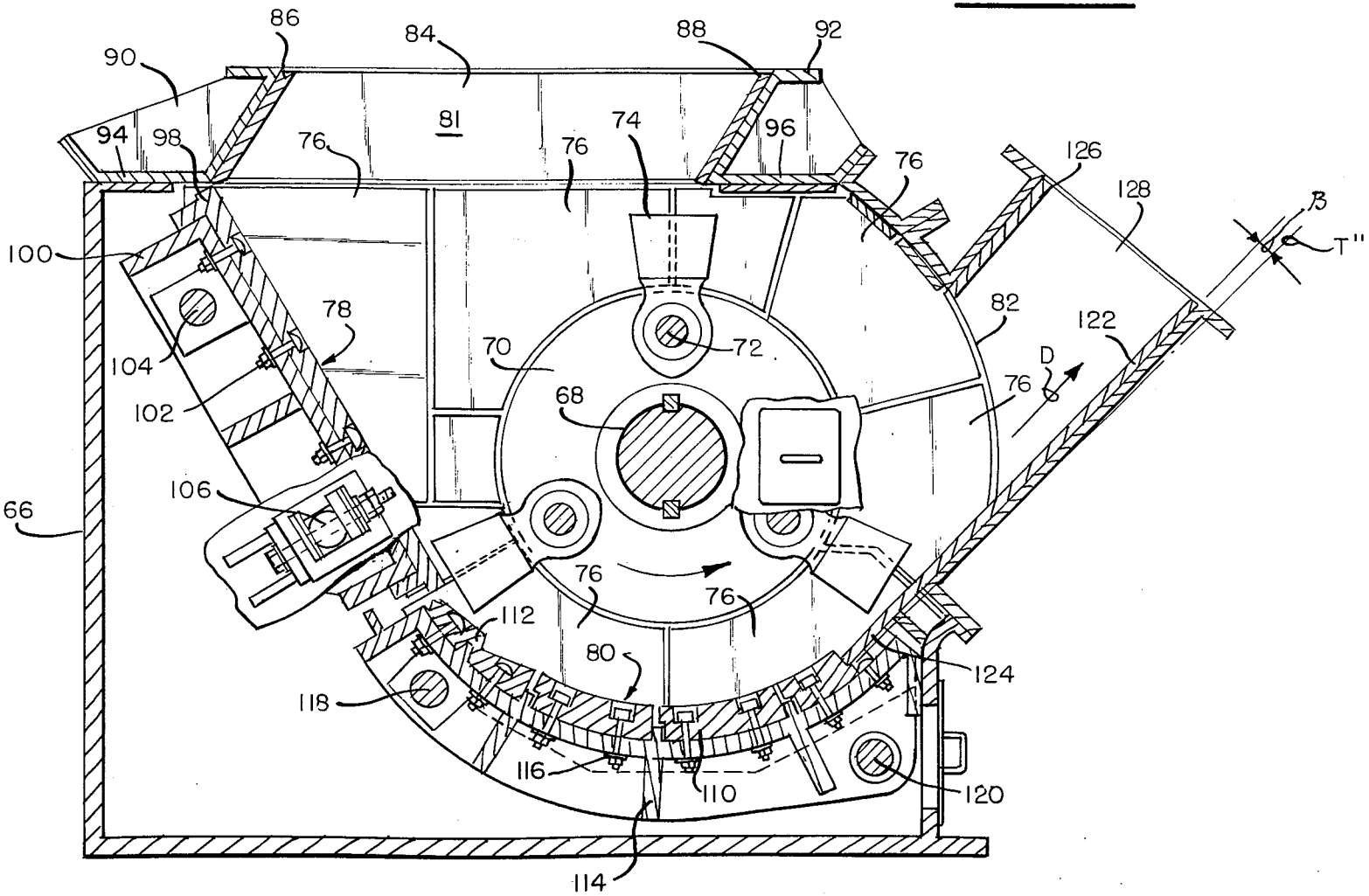
FIG. 3 is a sectional view of a preferred embodiment of the crushing machine of the present invention.

The presently preferred configuration of the apparatus shown in FIG. 3 has a housing 66 with rotor shaft 68 mounted for rotation in suitable bearings (not shown). Axially spaced rotor discs 70, carrying three hammer shafts 72, are mounted on shaft 68 for rotation therewith. The hammer shafts 72, mounted at 120° intervals near the peripheries of axially spaced rotor discs 70, serve as pivotal mountings for three axial rows of hammers, each row comprising one double width, two-shank hammer in the middle and a single width, one-shank hammer hammer arrangement are set forth in Ser. No. 361,002, previously discussed. The housing 66 includes side panels 76, the feed ramp 78, curved, imperforate impact member 80, inlet chute 81 and discharge chute 82, along with various other auxiliary equipment.

Inlet chute 81 is of the same width as the portion of the housing in which the hammers rotate, and it is defined by side walls 84, by downwardly and outwardly inclined end wall 86 and by downwardly and inclined end wall 88, as well as end wall supporting structures 90 and 92 which can be bolted to the housing at points 94 and 96 respectively. In the configuration shown, the inlet chute exhibits some tendency to urge incoming material from right to left generally in the direction of motion of the periphery of the downrunning rotor 68. However, the inlet chute end support members are so shaped that the chute can be unbolted and the positions of the ends reversed, so that the chute will then have a tendency to urge incoming material from left to right, generally in opposition to the direction of rotation of the hammers.

Upon entering the housing, incoming material may first encounter the hammers 74, or the housing side walls 76, or the feed ramp 78. This feed ramp has a replaceable wearing surface 98, held in place on a pivotally mounted platen 100 by mounting bolts 102. The platen pivot 104 is a horizontal bar extending between side walls 76 near the upper portion of the housing, spaced radially from the impactor circle. The lower end of the feed ramp is fitted with adjustable securing means 106, securing the lower end of platen 100 either closely adjacent to the impactor circle or at a plurality of positions at further radial spacings therefrom. For protection of the machine, the bar 106 may be of only limited strength so that it will break, allowing the feed ramp to swing down and "unload" the rotor, if the rotor encounters a large object that will not shatter, thus possibly averting self-destruction of the machine.

Imperforate impact member 80 also includes a plurality of replaceable wear surfaces 110, the first of which, 112, has corrugations formed therein. These wear surfaces are held in place on a curved base 114 by suitable mounting bolts 116. Impactor member 80 is also pivotally mounted on a fixed pivot 118. The cross bar 120 at the right or downstream side of the impact surface 80 can be secured to any suitable adjusting means, not shown, by means of which the right end of the base and associated wear surfaces can be moved radially closer or further from the impactor circle.

The discharge chute 82 has a lower or confining member 122 which comprises an upwardly sloping or curving surface extending from the right or downstream end of impact surface 80, along a path elevated above a line T″ tangent to terminal lip 124 of impact surface 80. Lower surface 122, upper surface 126 and side panels 128 define a chute having a completely closed circumference. The orientation of the chute generally corresponds to the trajectory imparted to the material at the downstream end of the inter-reaction zone. As previously discussed, the angle of member 122 may be adjustable, if desired. The additional direction changing and energy absorbing means has been omitted from this view to permit showing the other parts of the apparatus on the largest scale possible, but it is understood that such means will be generally similar to that shown in the other figures and to that described above.

The following is a summary of parameters of a purely illustrative machine similar to that shown in FIG. 3, designed for crushing cement rock. It uses a rotor having a hammer circle of 60 inches, which clears the impact surface by about ½ to 3 inches or more. The hammers are approximately 18 inches long and have a front face to back face width of about 9 inches. The single and double shank hammers have side to side widths of 12 and 24 inches respectively and weight about 320 and 700 pounds, respectively. The entire rotating mass including hammers, rotor discs, shafts, flywheel and sheaves is about 20,000 pounds, and the machine as a whole weighs less than 100,000 pounds. It appears capable of doing the work of previously known mobile crushers weighing several times as much.

The rotor is designed to turn at about 480 to 700 RPM. The presence of some heavier multi-shank hammers on the rotor makes it possible to get equivalent or better crushing performance at lower rotor speed and therefore lower levels of machine vibration amplitude and creep, as compared to a larger number of single shank hammers of the same total mass, rotating faster. Thus, it could for instance be possible to provide the machine with hammers which extended the full available width of the housing and had three or more shanks.

Uncrushed minerals recovered at the mine face or in a quarry can be quite large, as indicated previously. It is not uncommon for the uncrushed material to include significant quantities, e.g. including 10% or more by weight, of pieces larger than 6 inches across in their smallest dimension, ranging up to so-called "coffin sizes."

Figure 4:
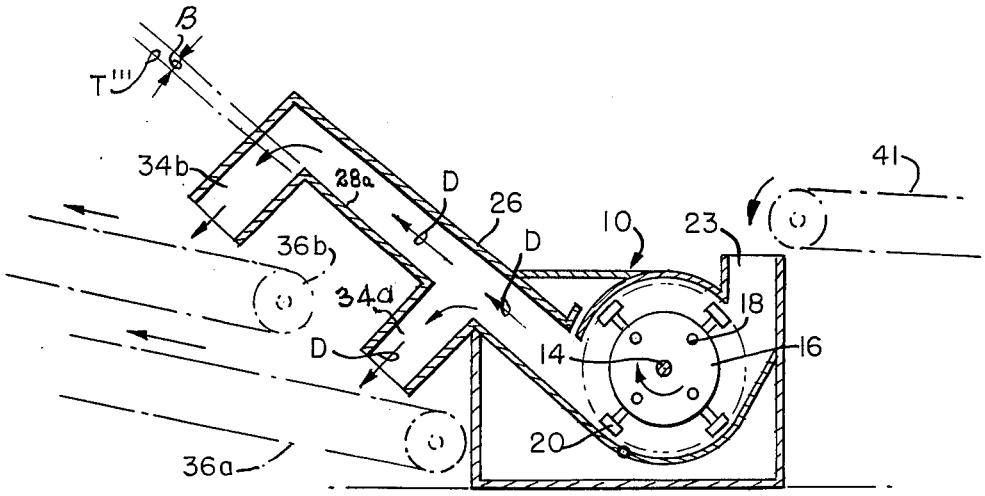
FIG. 4 is a schematic illustration of still another form of crushing machine embodying the invention.

FIG. 4 illustrates a crusher machine generally similar to that of FIGS. 1 and 3, but in FIG. 4 classification is obtained between the lighter fines and the heavier, larger particles. Discharge conduit 26 is provided with two or more discharge nozzles 34A and 34B so that the lighter fines discharge through the nearer nozzle 34A and the heavier particles discharge through the more remote nozzle 34B. Two or more output conveyor belts 36A and 36B are provided for carrying away the fines and the larger particles, respectively.

The nozzles 34A and 34B may also be arranged to discharge both fine and heavier particles to the same conveyor belt. Heretofore, it has been conventional practice to charge a crusher from a scalping conveyor. Such conveyor discards fines and feeds larger particles into the inlet of the crusher. The output conveyor under the crusher passes first under the fines discharge outlet of the scalping conveyor, laying down a layer of fines thereon, and then passes under the discharge outlet of the crusher to receive the crushed product, including both large and small pieces. The previously placed layer of fines on the conveyor cushions the shock of the larger crushed pieces from the crusher, thus protecting and extending the life of the conveyor belt. In accordance with the present invention, it is not necessary to pass the conveyor belt under both a scalping conveyor and the bottom of the crusher. The nozzles 34A and B may be so oriented relative to their common output conveyor, so that nozzle 34A lays down a protective layer of fines on the belt upstream of nozzle 34B. Thus, a scalping conveyor is no longer required.

In the preferred means and method of operation corresponding to the FIG. 4 embodiment, the rotor in the machine housing strikes, reduces and propels outwardly from the rotor a stream of solid material including lighter and heavier pieces. Means integral with and/or separate from the rotor are provided for generating a flow of air and for causing said stream and flow to enter discharge chute 26 together. The latter defines a first confined path away from the rotatable means for receiving the stream and causing it to continue in motion generally in the direction in which it is impelled by the blows of the impact members, at least until it passes beyond discharge nozzle 34A. Said nozzle defines a path diverging from the discharge chute 26, for diverting at least a portion of the air flow and at least a portion of the lighter pieces in the stream together from the discharge conduit. Discharge chute 26 may include a lower confining member 28A which has an upwardly sloping or curving surface extending from the downstream end of impact surface 24, along a path elevated above a tangent line T'', as discussed with regard to FIG. 1. If sufficient separation of fines is obtained at nozzle 34A, only a slight tendency for moist fines to accumulate on member 28A is found to exist on the upstream side of nozzle 34A. Thus, the surface of member 28A may be dropped beyond nozzle 34A, if desired, to be coincident with tangent T'' without danger of substantial clogging. In practice, it has been found expedient to continue the sloping or curving surface of member 28A all the way up the discharge chute.

The desired air flow can be generated by the rotating impact members themselves and/or by suitable fans. The heaviest pieces thrown off by the rotor will maintain their velocity in the direction in which they are propelled for a relatively long distance. The lighter pieces, having a lower mass-to-surface ratio, tend to lose their forward velocity more rapidly. Moreover, the flow of air departing through nozzle 34A effects a more efficient capture and separation of the lighter pieces. In order to insure that there is a sufficient flow of air into nozzle 34A, the nozzle 34B may be fitted with an air lock, or the nozzle 34A may have an air tight connection with a suitable receptacle in which suction is generated by a fan or other means.

Figure 5A:
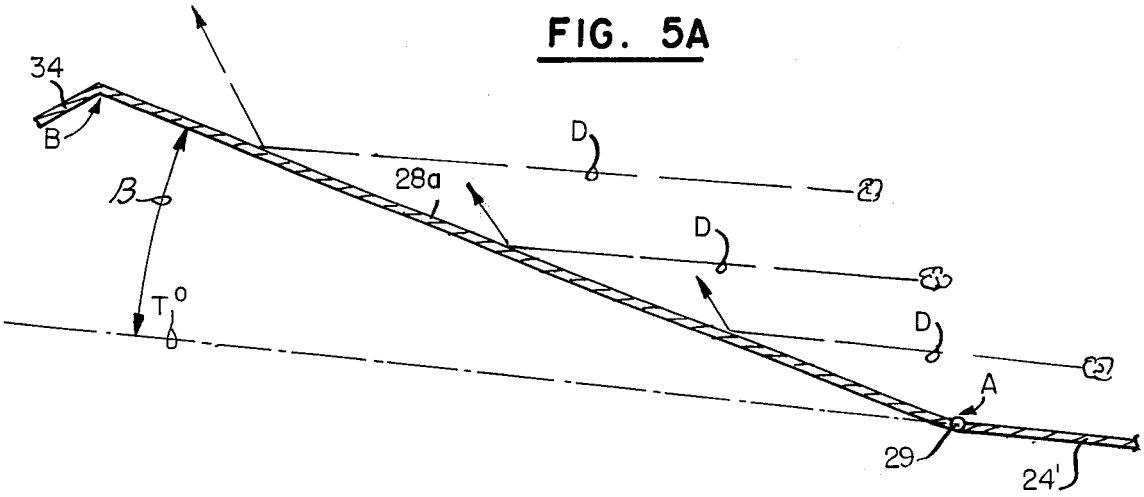
FIGS. 5A to 5E each show a fragmentary sectional view of the lower wall of the discharge chute of the present invention, illustrating alternative shapes therefore.

FIG. 5A shows an enlarged view of the lower surface or confining member of the discharge chute, identified as elements 28, 52, 122 and 28 in FIGS. 1 to 4, respectively. A portion 24' of the impact surface identified as elements 24, 58 and 80 in FIGS. 1 to 4 is shown, along with tangent T° extending from the downstream end of impact surface 24. As previously discussed, if lower surface member 28 is made coincident with tangent T°, clogging near end A of the discharge chute is frequently experienced. It has been found that elevating the lower surface of the discharge chute above the tangent T° can reduce or substantially eliminate clogging at end A.

Element 28*a* may be a flat plate which is elevated relative to tangent T° at an angle B, which is preferably between zero and approximately 10 degrees in magnitude, as shown in FIG. 5A. As pieces of crushed material are thrown out of the crusher by the impact members, many will follow paths generally parallel and closely adjacent to tangent line T° and eventually glance off the surface of element 28*a*, as indicated. This repeated contact with the surface of element 28*a* scours the surface of fine particles as they settle, thus preventing clogging. The angle B sufficient to cause scouring, while preserving the major portion of the kinetic energy imparted to the material, will vary with operating conditions as will be understood by those in the art. The greater the elevation of element 28*a* relative to tangent T°, the greater will be the scouring effect; however, elevations between zero and approximately ten degrees are preferred. At higher elevations, the wear on surface 28*a* may become excessive; furthermore, a significant amount of material may tend to rebound into the crusher where its size is again reduced perhaps unnecessarily. Of course, where the tendency of a particular material to clog is high, the elevation of element 28*a* may have to be increased to obtain the desired scouring effect, with concomitant increases in wear and material rebound.

Figure 5B:
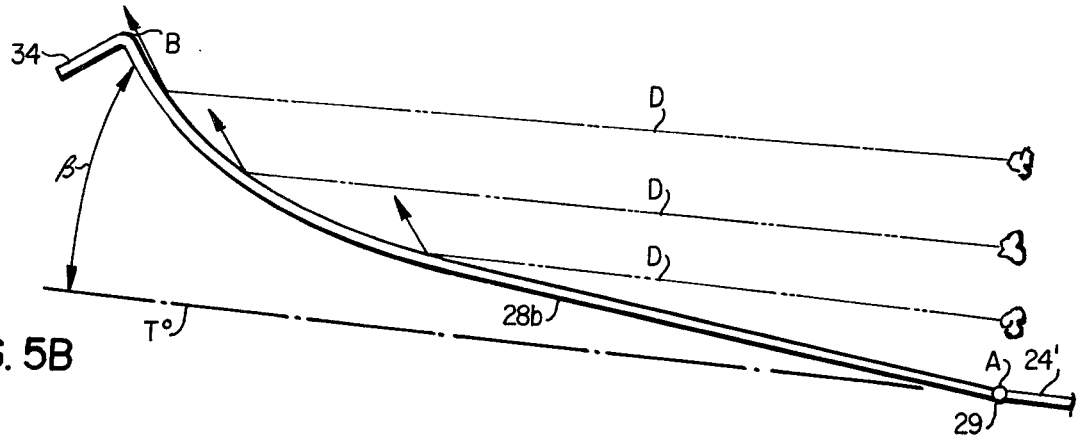
Figure 5C:
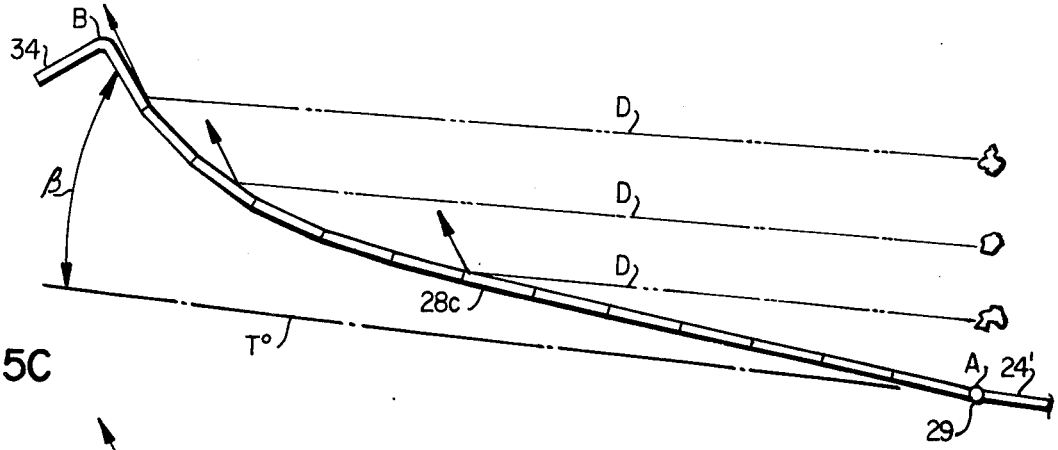
Figure 5D:
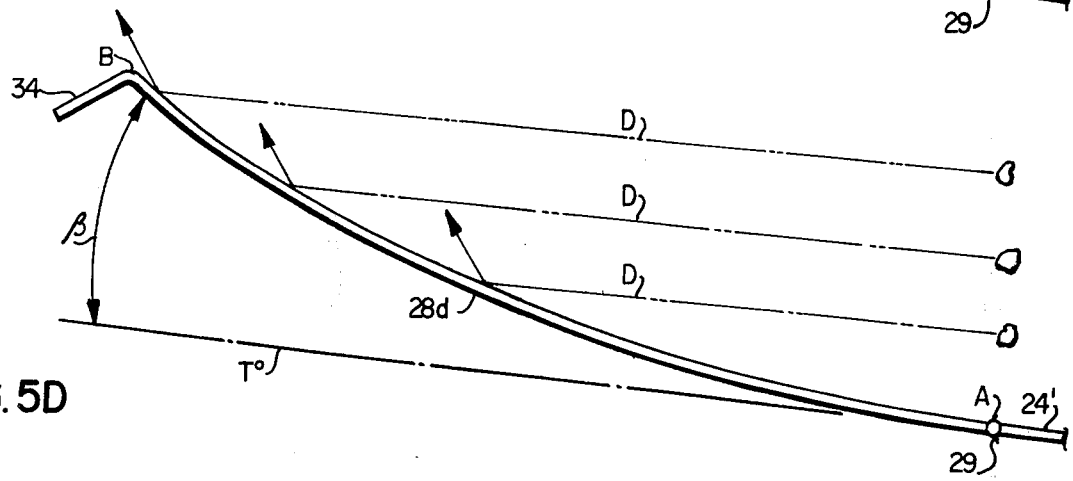
Figure 5E:
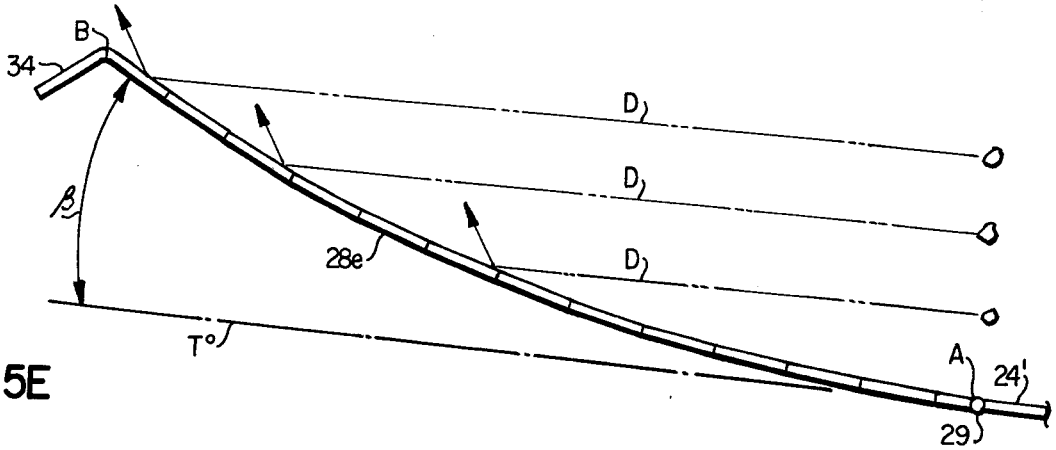

An alternative lower surface element 28*b* is shown in FIG. 5B. Element 28*b* is curved or involute in shape and extends from point A at the lower end of the discharge chute to point B at the upper end, so that the surfaces of both elements 28*a* and 28*b* begin and terminate in essentially the same locations. The more gradual upward rise of element 28*b* relative to element 28*a* provides an adequate scouring effect to prevent clogging, yet minimizes both obstruction of flow up the discharge chute and wear on its lower surface. As shown in FIG. 5D, the surface of element 28*d* also may be a simple upward curve having a constant radius of curvature; however, an involute form as in FIG. 5B is preferred. By "involute" is meant simple that the radius of curvature of the surface is decreasing continuously from A to B. This changing curvature of the surface results in increased centripetal force acting on particles skimming along the curved surface even as their tangential velocity decreases, which increases the scouring effect and eliminates adhesion of the particles. Both the involute and constant radius surfaces may be made from a continuous plate of material, as shown in FIGS. 5B and 5D. Alternatively, they may be made from a series of flat plates of progressively greater pitch relative to T° joined to approximate the involute or curved surfaces, without departing from the teachings of the invention, as shown in FIGS. 5C and 5E. It is contemplated that in the preferred embodiments, these types of lower surfaces for the discharge chute will substantially reduce or eliminate clogging or accumulataion of material at the discharge chute inlet; however, other variations may occur to one skilled in the art without departing from the scope of the invention.

Although practical difficulties have arisen in the past in respect to economically conveying such crushed materials to the surface or in crushing them economically and conveniently in the quarry or at the mine face, such difficulties should be reduced by the present invention. The present invention provides crushing apparatus which is simple, easy to load, potentially portable and not dependent on a high supporting frame or trench for discharging to a conveyor. The disclosed apparatus will crush and discharge moist minerals without significant clogging. Thus, it is now perfectly feasible to use a modestwidth belt conveyor, which is economical compared either to the use of trucks or the use of other kinds of conveyors previously considered necessary, to transport the crushed output directly from the crushing machine to the surface above or surrounding the mine or quarry. Thus, for instance, in the case of limestone, the crushed product may consist of particles of the order of 6 inches or less in their maximum dimension.

Based on the principles of the invention disclosed herein, those skilled in the art will readily develop other embodiments, all of which are intended to be protected by the appended claims.

We claim:

1. A method of crushing massive, high density materials such as rock and coal, comprising the steps of:

introducing mineral feed into a housing through an inlet open to the atmosphere;

allowing the mineral feed to drop from said inlet into the impactor circle of a rotor rotating within said housing, said rotor having impact members defining said impactor circle;

impacting said feed material with said rotating impact members as said feed material drops into said impactor circle to crush said materials;

causing said reduced material to move into contact with an imperforate impact surface in a rotor-feed material-impact surface inter-reaction zone subtending an arc including and extending upwardly from either side of the lowest point of said impactor circle, to further crush said material;

throwing substantially all material crushed by said rotor and said imperforate impact surface upwardly and outwardly from said rotor at the downstream end of said impact surface on the side of said lowest point opposite to the side on which said energy imparted thereto by said rotor; and impinging a portion of said material against the lower surface of an at least partially confined channel extending from said downstream end, said lower surface extending into the trajectory imparted to said material at said downstream end at an angle above a line tangent to said downstream end of said impact surface, said angle being sufficient to cause scouring of said lower surface by said material and to reduce clogging of said channel by said material.

2. The method of claim 1 further including the step of, while the crushed material is still in flight, impinging at least the largest pieces thereof against an energy absorbing and direction changing means; and then causing the crushed material to descend from said energy absorbing and direction changing means to discharge from the apparatus without further contact with said rotor.

3. Material reduction apparatus for mineral materials, comprising:

a. a rotor, having impact members mounted thereon, the periphery of which defines an impactor circle;

b. a housing for said rotor having a curved impact surface which defines the outer perimeter of a reaction zone in which said impact members, said mineral material and said impact surface interact, said reaction zone subtending an arc in said impactor circle, one end of the arc defining a downstream end of the impact surface and reaction zone; and c. a discharge chute defining a reduced material departure path generally corresponding to the trajectory imparted to the material at said downstream end, said chute having a direction changing and energy absorbing lower surface means extending longitudinally away from said rotor into said material departure path, at an angle above a line tangent to said downstream end of said impact surface, said angle being sufficient for causing scouring of said lower surface by said reduced material and for reducing clogging of said chute by said reduced material.

4. Apparatus in accordance with claim 3 wherein said impact members are a plurality of pivotable hammers.

5. Apparatus in accordance with claim 3 further comprising an additional direction changing and energy absorbing means connected with said outlet duct and oriented in the material departure path in position for deflecting at least the larger pieces thrown off by the rotor, for slowing such pieces by absorbing a major portion of the remaining kinetic energy thereof, and for discharging such material from the duct without recycling to said rotor.

6. Apparatus according to claim 5 wherein the discharge chute, upstream of the additional direction changing and energy absorbing means, provides an open discharge path for the larger pieces thrown into the duct by the rotor.

7. Apparatus according to claim 6 wherein said discharge path is higher than the axis of rotation of the rotor.

8. Apparatus according to claim 5 wherein said additional direction changing and energy absorbing means is positioned at the outlet of said discharge chute for causing the material which strikes it to descend to a receiver.

9. Apparatus according to claim 5, including means for rotating said rotor with the periphery of the rotor adjacent the impact surface moving in the direction of said discharge chute and with sufficient force to throw reduced material up the discharge chute and cause it to bounce from said additional direction changing and energy absorbing means to a discharge outlet.

10. Apparatus in accordance with claim 3 wherein said impact members are a plurality of bars mounted in the rotor in a cage configuration.

11. Apparatus according to claim 3 wherein said impact surface is a smooth, imperforate surface.

12. Apparatus according to claim 3 wherein said housing includes an inlet duct which is open to the atmosphere, so that air may be drawn into the housing as the feed material enters, a common flow path through the housing being provided for both air and feed up until such point that both have entered said discharge chute.

13. Apparatus according to claim 3 wherein an input conveyor is arranged to deliver feed material to said housing.

14. Apparatus according to claim 3 wherein the discharge chute is at least partly at an elevation higher than the low point of the impactor circle.

15. Apparatus in accordance with claim 3 wherein said lower surface extends at an angle of from 0° to 10° above a tangent drawn from said downstream end of said impact surface.

16. Apparatus in accordance with claim 15, wherein said lower surface is flat.

17. Apparatus in accordance with claim 15, wherein said lower surface is curved.

18. Apparatus in accordance with claim 17, wherein said curved surface comprises a series of flat plates of progressively by greater pitch joined to approximate said curve.

19. Apparatus in accordance with claim 15, wherein said lower surface is involute.

20. Apparatus in accordance with claim 19, wherein said involute surface comprise a series of flat plates of progressively greater pitch joined to approximate said involute.

21. Apparatus in accordance with claim 3 wherein said lower surface is flat.

22. Apparatus in accordance with claim 3 wherein said lower surface is curved.

23. Apparatus in accordance with claim 22, wherein said curved surface comprises a series of flat plates of progressively greater pitch joined to approximate said curve.

24. Apparatus in accordance with claim 3 wherein said lower surface is involute.

25. Apparatus in accordance with claim 24, wherein said involute surface comprises a series of flat plates of progressively greater pitch joined to approximate said involute.

* * * * *